United States Patent [19]
Buchanan
[11] 4,266,880
[45] May 12, 1981

[54] PAPER INSERTION APPARATUS

[75] Inventor: James C. Buchanan, Lexington, Ky.
[73] Assignee: International Business Machines Corporation, Armonk, N.Y.

[21] Appl. No.: 945,921
[22] Filed: Sep. 26, 1978
[51] Int. Cl.[3] ..... B41J 19/76
[52] U.S. Cl. ..... 400/550; 400/549; 400/568; 400/572; 400/575; 400/582; 400/598; 400/639.1
[58] Field of Search ..... 400/549, 550, 568, 570, 400/572, 573, 575, 578, 582, 598, 636, 636.1, 639.1, 639.2; 364/200

[56] References Cited

U.S. PATENT DOCUMENTS

| | | | |
|---|---|---|---|
| 1,913,831 | 6/1933 | Clark | 400/549 X |
| 2,200,693 | 5/1940 | Geiser | 400/598 |
| 2,204,243 | 6/1940 | Anderson | 400/639.1 X |
| 2,210,168 | 8/1940 | Hart | 400/639.2 X |
| 2,353,407 | 7/1944 | Kurowski | 400/636 X |
| 2,463,259 | 3/1949 | Giauque | 400/550 |
| 2,472,340 | 6/1949 | Prezioso | 400/598 |
| 2,711,811 | 6/1955 | Lambert | 400/578 X |
| 2,944,651 | 7/1960 | Malcolm et al. | 400/550 X |
| 3,276,562 | 10/1966 | Mathews | 400/549 |
| 3,292,762 | 12/1966 | Erickson | 400/550 |
| 3,960,258 | 6/1976 | Aebi | 400/550 |
| 4,031,995 | 6/1977 | Blum et al. | 400/636.1 |
| 4,057,846 | 11/1977 | Cockerill et al. | 364/200 |
| 4,085,837 | 4/1978 | Takano et al. | 400/568 X |
| 4,087,852 | 5/1978 | Campbell et al. | 364/200 |

OTHER PUBLICATIONS

IBM Technical Disclosure Bulletin, "2-3-6 Lines/Inch Platen Indexing Method", Becker, vol. 17, No. 8, Jan. 1975, pp. 2355-2356.

IBM Technical Disclosure Bulletin, "Paper-Bail Actuation During Unattended Printout", Nilsson et al., vol. 19, No. 6, Nov. 1976, p. 1957.

IBM Technical Disclosure Bulletin, "Index Auto Paper Feed", Abell et al., vol. 20, No. 10, Mar. 1978, pp. 4000-4001.

*Primary Examiner*—Ernest T. Wright, Jr.
*Attorney, Agent, or Firm*—George E. Grosser

[57] ABSTRACT

Improved apparatus for effecting semi-automatic insertion of paper into a typewriter concentrates operator interactions, (1) to condition the typewriter for a distance input selection and (2) to trigger indexing for paper insertion, so as to merely involve positioning of the paper bail. A detection of the paper bail at a predefined position withdrawn from the paper feed path conditions the typewriter to interpret keyboard actuations—preferably of the number keys—as representing desired first line distances e.g., the "2" key represents a first line one inch from the top of the sheet. And, in a presently preferred implementation, the number keys represent a fixed distance increment (three lines or approximately one half inch) multiplied by the key number. The represented distance, including any feed path distance to move the top of the sheet from the entrance point to the print line, is stored in memory and a transfer of the paper bail from the detected position then serves to trigger paper indexing that corresponds to the stored distance.

6 Claims, 10 Drawing Figures

PAPER INSERTION APPARATUS

CROSS REFERENCE TO RELATED APPLICATION

Reference is made below to copending U.S. Patent Application Ser. No. 945,922 Filed Sept. 26, 1978 in the name of John Joseph Bisczat, et al and entitled "Paper Insertion Apparatus For A Typewriter". This patent application is assigned to the assignee of the present invention.

BACKGROUND OF THE INVENTION

1. Field of the Invention

The invention relates generally to paper handling for a typewriter and, more particularly, to apparatus for advancing a sheet of paper to a desired first line printing position.

2. Statement Regarding the Prior Art

Various apparatus has been proposed and implemented for semiautomatically inserting paper into a typewriter. Generally, however, such apparatus has had limited appeal because complicated special purpose mechanisms were required that unduly increased machine costs and because the operator was required to learn a somewhat involved procedure to achieve a result that could be accomplished manually with only a moderate effort.

The increase in costs and complexity arises because provision must be made for operator indication of the desired first line printing position and because the paper path must be prepared for paper insertion, for example, by moving a paper hold-down device at the printing line out of the paper path so as not to interfere with the leading edge of the incoming page (or pack including carbons).

Various selector devices have been used to allow the operator to indicate a desired first line printing position. Typically a dial (see e.g., U.S. Pat. Nos. 3,960,258 and 3,276,562) or a selection lever (see e.g., U.S. Pat. No. 2,463,259) is employed for indicating the desired first printing line and these devices are coupled to mechanical stops or clutch disengaging devices to limit total paper advance.

The problem of getting the leading edge of the paper past the printing zone has proven to be a troublesome one. To achieve the basic typing function, i.e., the crisp printing of characters, the paper must be held snugly to the platen in the printing zone. But the paper hold-down device, typically a series of rollers on a bail, does not, when in operative position, allow easy passage of the paper past the printing zone. In fact, jamming typically occurs if the bail is not manually withdrawn and such jamming may cause unacceptable creasing of the paper.

One solution to this problem is to use a shaped guide plate (see e.g., U.S. Pat. No. 2,353,407) rather than rollers to hold the paper in position, but such an arrangement would appear to have problems holding the paper effectively at the print line, especially if clearance provision must be made for thick carbon packs. A more common solution has been to provide an automatic drive arrangement for the paper hold-down bail (see e.g., U.S. Pat. Nos. 2,204,243; 2,210,168; 3,292,762; 3,960,258; and 4,031,195).

There is, of course a significant cost penalty for such limited purpose automatic drive mechanisms and there is possibly a maintenance problem if, for example, rearward hand or arm pressure is accidentally applied against the bail when it is being driven forward.

Hence, with prior art devices the convenience of semi-automatic paper insertion has involved significant cost penalties and special set up procedures that are rather distinct from manual paper insertion and, therefore, are not convenient for the operator to learn.

SUMMARY OF THE INVENTION

In the above-referenced copending U.S. Application Ser. No. 945,922, Filed Sept. 26, 1978, a detector is described that responds to the position of a paper hold-down device of a typewriter and serves to trigger a powered paper insertion. The present invention recognizes that, by using the extinction of the signal of such a detector to trigger actual paper insertion, the detection signal itself can advantageously be employed to condition the typewriter to receive a first line distance selection from the keyboard, preferably by means of the number keys. During the detection interval (i.e., while paper bail presence is detected at a withdrawn position) the normal response to keyboard codes is preferably suppressed and respective preselected keyboard codes are interpreted to represent first line distances, e.g., the "1" key corresponds to one-half inch, the "2" key corresponds to one inch and so on. Operator transfer or release of the paper bail from the detected position, which is preferably an extreme withdrawn position that is spring biased to be unstable, serves to trigger automatic advance of the paper according to the last operator selected top line distance, or, if none was selected, to a default value. By so providing for double use of the detection signal the necessary operator control interactions are conveniently concentrated in the paper bail lever and the desired sequence of "select-then-trigger" is, in effect, imposed inherently. Furthermore by causing, in accordance with a preferred implementation, the number values for the number key row to represent multipliers for a fixed basic distance increment, e.g. three lines (approximately one-half inch), the distances represented by the various keys are easily associated by the operator with first line distances.

The invention will now be described with respect to preferred implementations thereof and with reference to the drawing wherein: FIG. 1 is a perspective view of a typewriter suitable for use according to the invention;

Figure 4A:
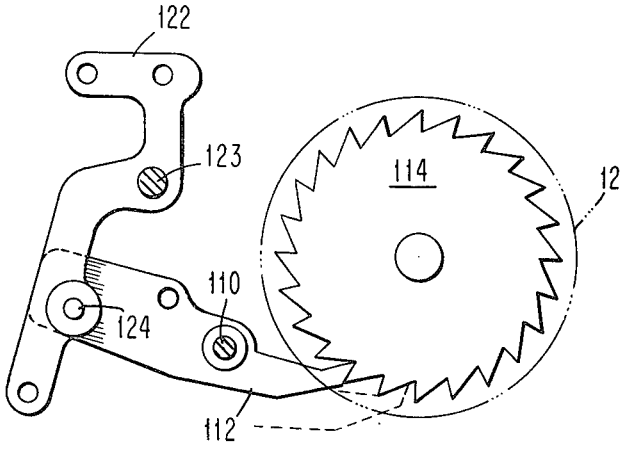
FIG. 4 is a cutaway representation in perspective of a presently preferred indexing mechanism that permits special paper advance for paper insertion at a triple line rate without the loss of the operator selected line advance setting for normal operation.
Figure 8:
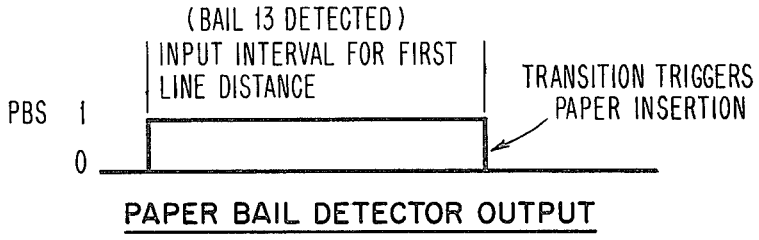
Figure 3:
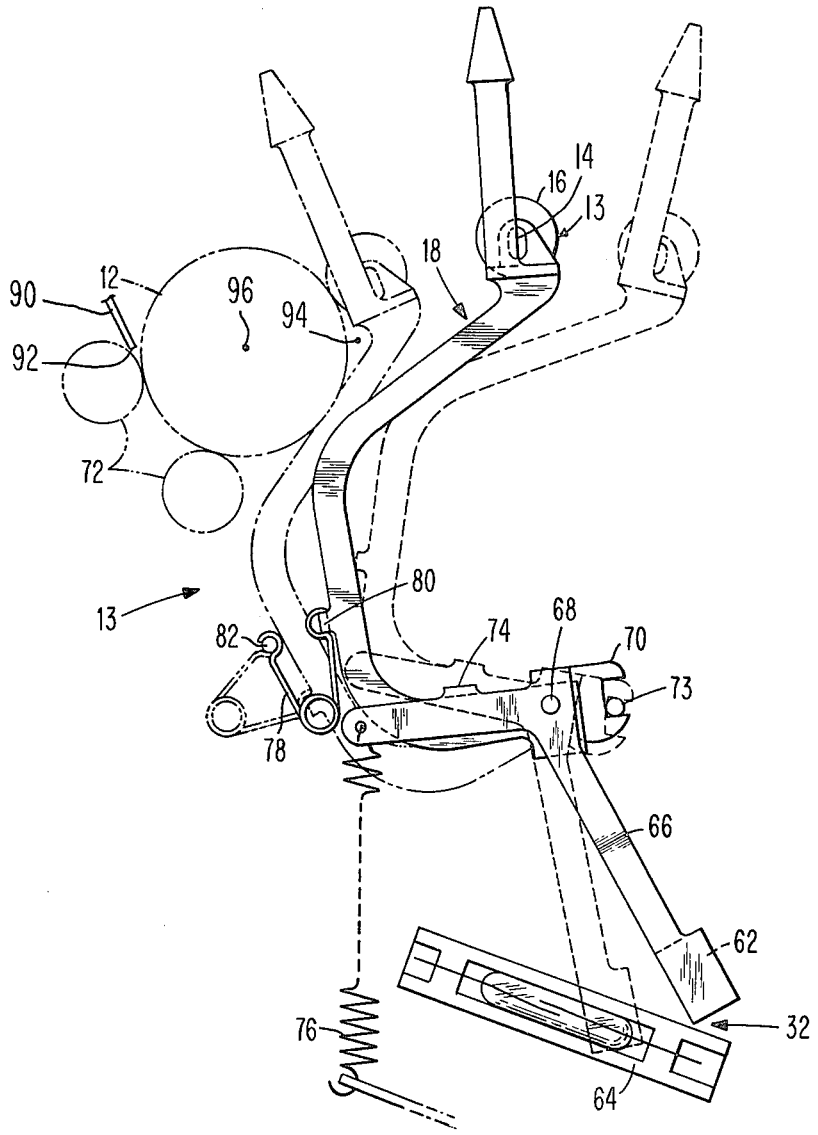
FIG. 3 is a sectional representation, viewed along the line 3—3 of FIG. 1, for a presently preferred paper hold-down device with associated detector.
Figure 4:
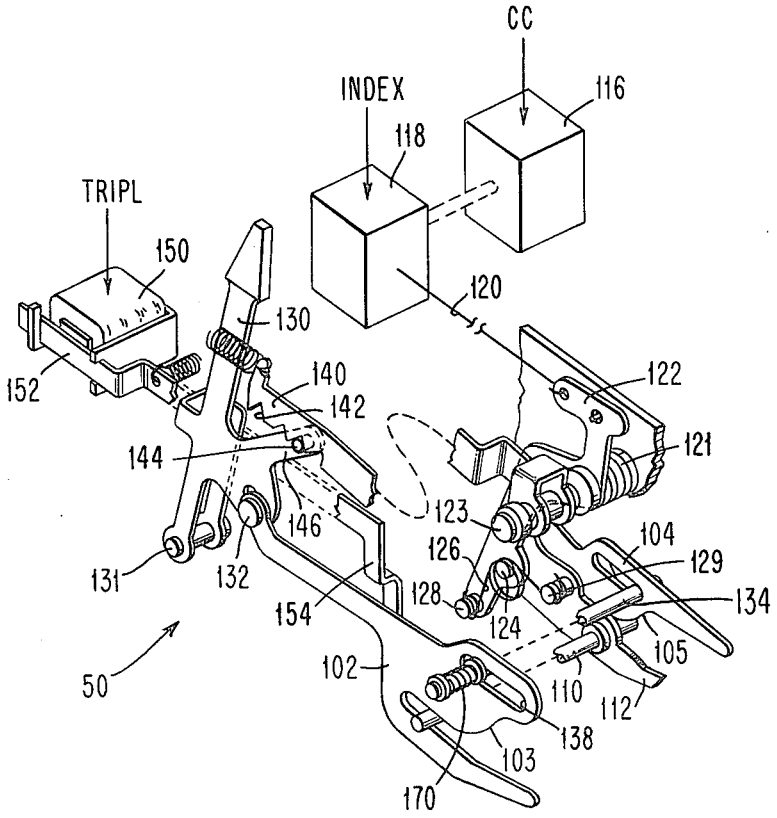
Figure 5:
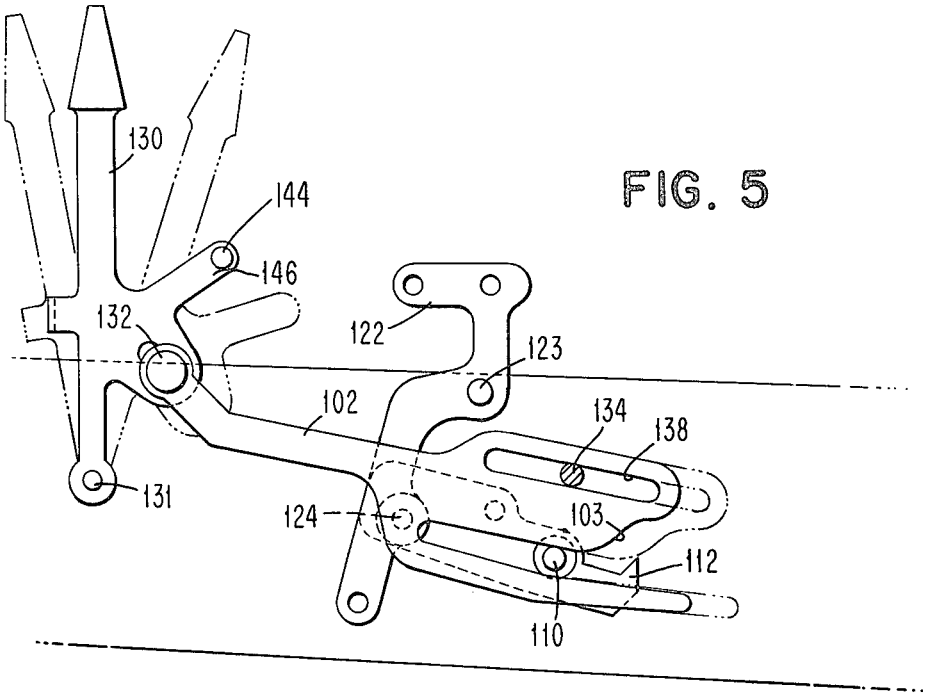
Figure 6:
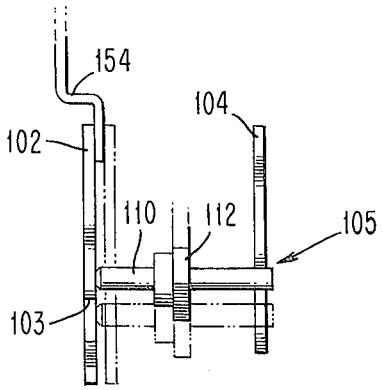
Figure 7:
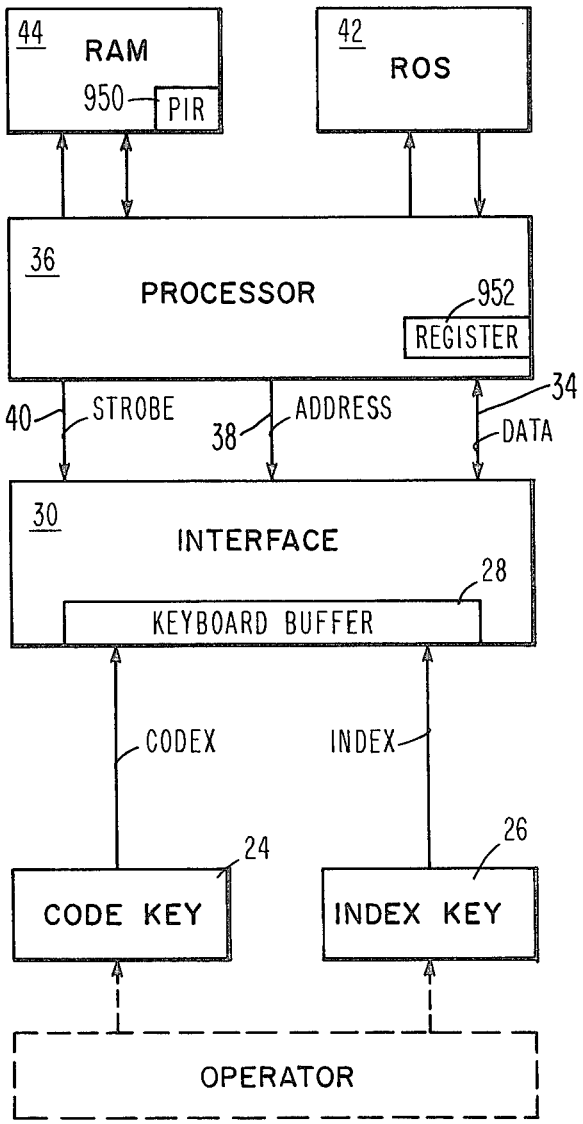
Figure 9:
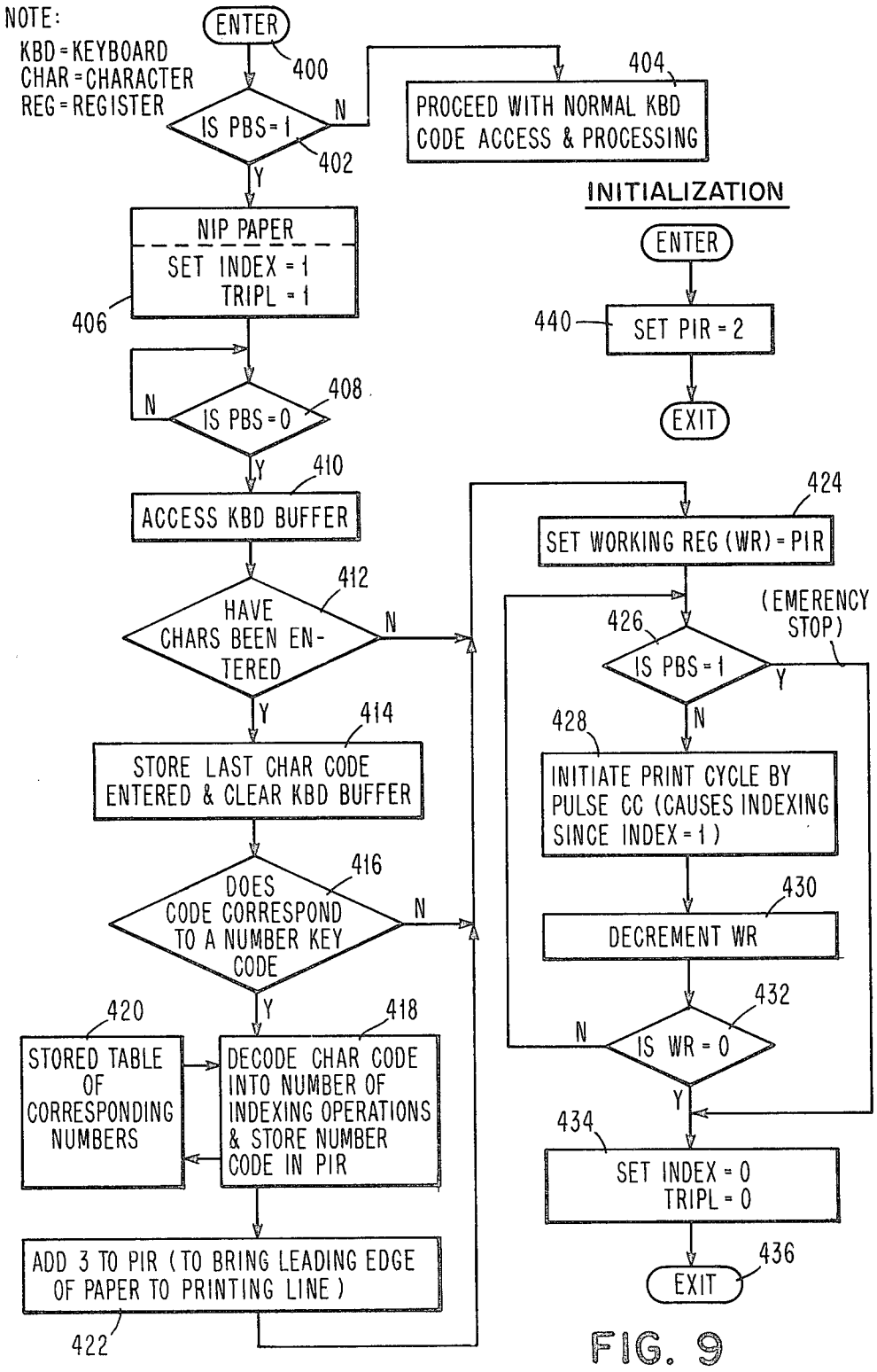

FIG. 4*a* is a side view showing detail of the pawl and ratchet of the mechanism of FIG. 4;

FIG. 5 is a side view showing detail of the line advance selection for the mechanism of FIG. 3;

FIG. 6 is an end view showing detail of cam surface transfers for the mechanism of FIG. 3;

FIG. 7 is a diagram in block form indicating a presently preferred, first line distance input arrangement;

FIG. 8 is a diagram indicating significant signal intervals for the presently preferred implementation of the invention; and FIG. 9 is a flow diagram indicating the sequential processing for the presently preferred implementation of the invention.

Figure 1:
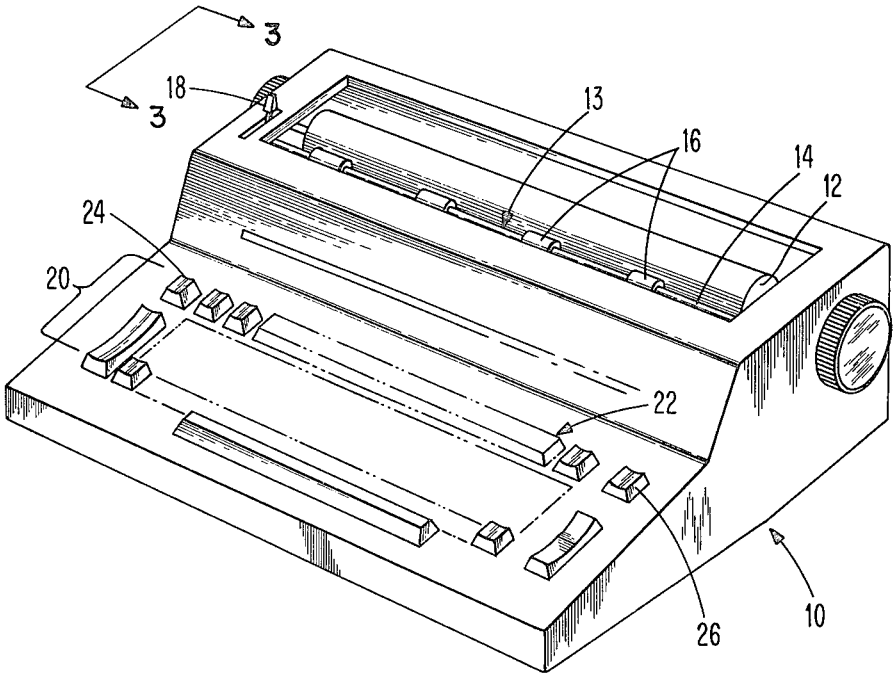

Referring to FIG. 1, a typewriter 10 suitable for use according to the invention includes a platen 12 and a paper hold-down device 13 such as a paper bail, 14 which supports a set of rollers 16 and is coupled to a control lever 18. Signals representing character printing and functional commands are generated by a keyboard 20 having various keys including a set of number keys 22, a code key 24 and an index key 26.

Figure 2:
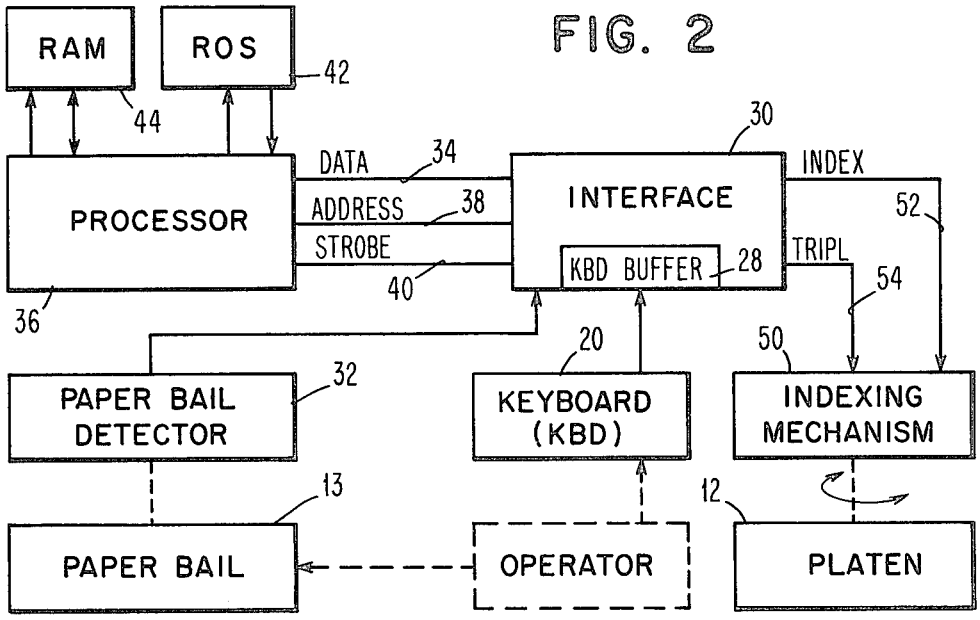
FIG. 2 is a system diagram in block form indicating basic signal flows for preferred implementations for the invention.

Activation of the typewriter 10 (indicated in FIG. 2) is generally initiated by the typewriter operator who, as is indicated by dashed lines, interacts with keyboard 20 to produce coded signals which are supplied to a keyboard buffer 28 of an interface device 30. Manipulation of the paper bail lever 18, as is described in detail below, causes a detector 32 to produce signals that are supplied to the interface 30. At the interface 30, signal information is buffered for transmission over a set of data lines 34 to a processor 36, such transmission being in response to respective addresses asserted on an address bus 38 in conjunction with a timing or strobe signal 40 as is well known in the art. While decoding and buffering is centralized in the interface 30 as shown (such an interface can, for example be employed with a processor having the bus structure described in U.S. Pat. No. 4,057,846) it will be appreciated that individual interface devices could be employed at the input and output devices, such as the keyboard 20, as is described in U.S. Pat. No. 4,087,852. The processor 36 is adapted to perform various basic logic functions and a read only storage (ROS), 42 incorporates the sequence of basic processor operations to be performed in the form of physical structures, as is known in the art. In performing such sequences or procedures, accessable code storage is occasionally required as provided by a read/write memory (RAM) 44.

Signals are sent from the processor 36 over the data lines 34 to the interface device 30 for controlling various output devices (again selected by corresponding addresses asserted on address bus 38), for example, the character selection apparatus (not shown) and an indexing device 50 which is mechanically coupled to drive the platen 12. In particular, addresses are assigned to an INDEX command signal 52 and a TRIPL command signal 54, which signals are supplied to the indexing device 50 via the interface 30 (which decodes the addresses to select the corresponding output channel) to cause an indexing operation and a shift to triple space increments respectively as is discussed in more detail below.

Referring to FIG. 3, a presently preferred paper hold-down device 13 for use according to the invention cooperates with a detector 32 having a magnet 62 and a reed switch 64 that is rigidly mounted to the typewriter frame (not shown). The magnet 62 is attached to an arm 66 that is pivoted at a pin 68 and includes a motion-limiting notched tab 70 that cooperates with a pin 73. Motion is transmitted to the arm 66 by engagement of the paper bail lever 18 with a tab 74. The lever 18 pivots about the pin 68 and is selectively moveable to three significant positions; a paper hold-down position (phantom lines) a stable withdrawn position (solid lines) and an unstable extreme withdrawn position (dashed lines). In extreme ("detection") position the arm 66 is driven against the opposing force of a spring 76 to a position where the field of magnet 62 influences the reed switch 64 to assume a conducting state and the spring force causes the position to be unstable. For the stable withdrawn position lever 18 is held in place by a toggle spring 78 that is connected between a tab 80 and a fixed pin 82. In the paper hold-down position, lever 18 is urged by the spring 78 for biasing paper bail rollers 16 against the platen 12, which in cooperation with sets of rollers 72 defines a paper feed path.

A receiving medium 90, typically a sheet of paper, is indicated at a paper entrance 92 defined at the nip of the rollers 72 and platen 12. As is conventional, a printing line 94 of the typewriter 10 is established parallel to the longitudinal axis 96 of the platen 12. Character formation occurs along the printing line 94 during printing operation of typewriter 10 and various well known printing mechanisms (not shown) may be employed to form characters, e.g. a ball element printer or a ballistic wire printer.

Referring to FIGS. 4 and 4a, a presently preferred indexing mechanism 50 includes a first cam element 102 with a profile surface 103 for use in normal indexing operation and a second cam element 104 with a profile surface 105 that provides high speed indexing for paper insertion. A pin 110 serves as the cam follower and is affixed to a pawl 112 for controlling the point at which the pawl 112 engages a ratchet wheel 114 that is connected to the platen 12 (the longer the engagement the greater the advance increment). A drive motion for the pawl 112 is transmitted from a drive shaft (not shown) through a cycle clutch 116 to an indexing clutch 118 and then through a linkage 120 to a pivoted pawl carrier 122 that is rotatable about a pin 123 and is biased to pull against the linkage 120 by a spring 121. Cycles of operation are initiated by the signal CC which is supplied to the cycle clutch 116 as is well known in the art. Pawl carrier 122 is connected to the pawl 112 by a pin 124 and a spring 126 tensioned between studs 128 and 129 serves to urge the pawl 112 toward the profile surfaces 103 and 105 respectively of the cam elements 102 and 104. The drive motion causes pawl 112 to reciprocate (a forward pawl position is indicated in dashed lines in FIG. 4A) and the extent of the cam profile 103 engaged by the pin 110 is manually adjustable by the operator by means of a selection lever 130 pivoted about a pin 131. Coupling of the cam element 102 to selection lever 130 is accomplished by means of a pin 132 and motion of the cam element 102 is constrained by a fixed pin 134 which passes through a slot 138 (see also FIG. 5, where dashed lines indicate alternate cam position selections for the cam element 102).

Discrete indexing positions are established by a detent bar 140 (see also FIG. 4) which is spring biased about the pivot pin 123 to engage, at a detented edge 142, a pin 144 which is arranged on an arm 146 of the selection lever 130. For the normal or operative position of cam element 102, profile surface 103 is forward of or in line with profile surface 105 and hence controls the engagement point of pawl 112. Transfer of follower 110 from cam element 102 to cam element 104 is effected by means of an electromagnet 150 having armature 152 with an extended arm 154 that, when moved to an actuated position, engages and deflects the cam element 102 laterally (see FIG. 6). Activation of electromagnet 150 is effected by a signal denoted TRIPL and in the absence of an activating signal level to cause deflection of arm 154, a spring 170 provides sufficient force to urge cam element 102 to the normal position for camming engagement with follower pin 110. Whenever the signal TRIPL activates electromagnet 150, the follower pin 110 is urged against the generally less prominent profile surface 105 (see FIG. 6), which permits the pawl 112 to engage the ratchet wheel 114 over a relatively long portion of the pawl stroke and provides a three line indexing increment. The engagement point for such three line increment operation is, of course, essentially the same as would occur with cam profile 103, if the operator selects a three line increment using the lever 130.

Referring to FIG. 7, a presently preferred signal processing arrangement for operator input of a first line distance code utilizes the signal PBS of the detector 32 to trigger a conditioning of the processor 36 to receive distance information from the keyboard 20 (FIG. 1). Such distance information, preferably number key codes, is decoded using a stored conversion table or procedure. Corresponding codes representing indexing increments to achieve the desired first line are produced and are stored in a PIR location 950 of RAM 44. Preferably, the transition in the state of signal PBS when the paper bail 14 is transferred from the detection position (see also FIGS. 3 and 8) causes the processor 36 to access the code stored at PIR location 950 and command a corresponding number of indexing operations.

The signal processing sequence that is dictated by the structure of the ROS 42, and causes operation according to the invention under control of the processor 36, is now considered with reference to the diagram of FIG. 9. Such diagram describes the structure in terms of basic processing operations that can be straightforwardly implemented in various processor systems (see discussion with respect to FIG. 2) by those skilled in the art. The presently preferred paper insert operational sequence is entered (block 400) from an overall input servicing (or polling) loop implemented by processor 36, as is well known for implementing multiple input processor systems such as processor controlled typewriters, and begins with a test (block 402) to determine the detection state of the detector 32. If the paper hold-down device 13 is not in the detection position (see dashed lines FIG. 3), normal processing of the coded signals from keyboard 20 proceeds (block 404), as is well known in the art. By this comparison operation (block 402) the processor 36 effectively disables or circumvents normal keyboard signal processing if the signal PBS is in the detection state (assumed here to be the logic "one" state). For the detection state of signal PBS, a triple index is triggered (block 406) to nip paper presented at the paper entrance 92 (to free the operator's right hand from holding the paper in place).

A delay is interposed (block 408) until the paper hold-down device 13 is released from the detection position, as indicated by the signal PBS assuming the logic "zero" state, and then the keyboard buffer 28 is accessed (block 410) to determine if the operator has performed any keyboard operations while the paper hold-down device 13 was in the detection position (block 412). If so, the last character code entered is accessed and the buffer 28 is cleared (block 414). The character code is then tested to determine if, in particular, a number key code has been asserted (block 416), this in accordance with the presently preferred implementation for the invention. Such number code is then decoded (block 418) using a table (block 420) stored in the ROS 42 to produce a code representing a preselected number of indexing operations, e.g., the "2" key code preferably corresponds to two triple indexes. To account for the paper path distance to bring the leading paper edge to the printing line 94, a fixed number of indexing operations is added (block 422) to the stored number. At this point or previously if no valid characters were entered (a failure of either the block 412 or block 416 test), the value from the PIR location 950 is duplicated in the working register 952 (block 424).

In a repeated loop (blocks 426, 428, 430, and 432), indexing operations are triggered and the total in the register 952 is decremented with each indexing operation until the register total is reduced to zero (block 432).

An emergency stop is provided, for enhancement of operator control and is triggered (block 426) if the paper hold-down device 13 is again moved to the detection position. Once one of the loop tests (block 426 or 432) is satisfied, an emergency stop has occurred or the desired paper insertion has been completed and the output signals INDEX and TRIPL are reset (block 434) to logic "zero" followed by a return to the overall input servicing loop (block 436).

As a further enhancement, an initialization procedure is included in the normal logic operations when the machine is powered on. Such an initialization causes (block 440) a default first line code (e.g. the code representing the number "2") structured into the ROS 42 to be written into the PIR location 950 to provide for the situation where the operator fails to input such a code.

The invention has been described in detail with reference to preferred implementations thereof, however, it will be appreciated that modifications and variations are possible. For example, various detectors may be used to detect the position of the paper bail and the absence of the paper bail in other positions may be used to indicate presence in the detection position. Also, rather than use a read only memory structure to coordinate operation of a processor that is capable of using a few basic processing circuits repeatedly, the signal processing may be implemented using "unshared" basic processing circuits, by those having ordinary skill in the art, based on the described methodology of operation for the invention.

I claim:

1. Improved semi-automatic paper insertion apparatus for use in a typewriter of the kind having a keyboard including number keys for producing coded signals in response to operator key actuations, a platen that serves in defining a paper feed path extending past a printing line, an operator manipulable paper hold-down device that has a first position at said paper feed path and a second position withdrawn from said paper feed path, a detector for producing a detection signal indicating the presence of said paper hold-down device in said second position and an indexing device that advances paper along said paper feed path in accordance with an indexing control signal, said paper insertion apparatus comprising:

a storage having stored therein at least one predetermined distance code representing a paper insertion distance, first control means, activated by said detection signal, for disabling normal processing of keyboard code signals and for accessing in accordance with any one of a preselected set of keyboard code signals a corresponding distance code from said storage;

means, cooperating with said first control means, for storing said accessed distance code at an indexing storage location; and insertion control means, responsive to a transition in the state of said detection signal indicating movement of said paper hold-down device from said second position, for accessing said distance code at said indexing storage location and for supplying a corresponding set of control signals to said indexing device, whereby a sheet of paper may be advanced a distance that corresponds to an operator keyboard selection.

2. Paper insertion apparatus according to claim 1 wherein a reassertion of the detection signal during paper insertion blocks said insertion control means from supplying control signals to said indexing device.

3. Improved semi-automatic paper insertion apparatus for use in a typewriter of the kind having a keyboard for producing coded signals in response to operator key actuation, paper handling means that defines a paper feed path having an entrance point, which paper handling means cooperates in establishing a printing line, an operator manipulable paper hold-down device that has a first position at said paper feed path and a second position withdrawn from said paper feed path, a detector for producing a detection signal indicating the presence of said paper hold-down device in said second position and an indexing device that advances paper along said paper feed path in accordance with an indexing control signal, said paper insertion apparatus comprising:

a storage having stored codes representing paper insertion distances, said codes being stored in locations corresponding to respective preselected keyboard codes;

storage control means, responsive to said detection signal, for disabling normal processing of keyboard code signals and for accessing, based on incoming keyboard code signals, corresponding distance representative codes from said storage;

code processing means for receiving a distance representative code accessed by said storage control means and for writing said distance representative code into an indexing code storage location;

insertion control means, responsive to a transition in the state of said detection signal indicating movement of said paper hold-down device from said second position, for accessing said indexing code storage location to obtain said distance representative code and for supplying a corresponding set of control signals to said indexing device, whereby a sheet of paper is advanced a distance from said entrance point that corresponds to an operator keyboard selection.

4. Paper insertion apparatus according to claim 3 wherein said processing means changes said distance representative code by adding an amount related to the distance from said entrance point to said printing line.

5. Improved semi-automatic paper insertion apparatus for use in a typewriter of the kind having a keyboard including number keys for producing coded signals in response to operator key actuations, a platen that serves in defining a paper feed path, an operator manipulable paper hold-down device that has a first position at said paper feed path and a second position withdrawn from said paper feed path, a detector for producing a detection signal indicating the presence of said paper hold-down device in said second position and an indexing device that advances paper along said paper feed path in accordance with an indexing control signal, said paper insertion apparatus comprising:

a storage having stored therein at least one predetermined distance code representing a paper insertion distance, first control means, activated by said detection signal, for disabling normal processing of keyboard code signals and for accessing in accordance with a keyboard code signal for a number key a corresponding distance code from said storage, which represents a distance proportioned according to the corresponding number;

means for storing said distance code at an indexing storage location; and insertion control means, responsive to a transition in the state of said detection signal indicating movement of said paper hold-down device from said second position, for accessing said distance code at said indexing storage location and for supplying a corresponding set of control signals to said indexing device, whereby a sheet of paper may be advanced a distance that corresponds to an operator depression of a number key.

6. Improved semi-automatic paper insertion apparatus for use in a typewriter of the kind having a keyboard, including number keys, for producing coded signals in response to operator key actuations, paper handling means that defines a paper feed path having an entrance point, which paper handling means cooperates in establishing a printing line, an operator manipulable paper hold-down device that has a first position at said paper feed path and a second position withdrawn from said paper feed path, a detector for producing a detection signal indicating the presence of said paper hold-down device in said second position and an indexing device that advances paper along said paper feed path in accordance with an indexing control signal, said paper insertion apparatus comprising:

an insertion distance storage having stored codes representing paper insertion distances, said codes being stored in locations corresponding to respective preselected keyboard codes for said number keys, and said represented distances being related to the corresponding numbers, storage control means, responsive to said detection signal, for disabling normal processing of keyboard code signals and for accessing, based on incoming keyboard code signals, corresponding distance representative codes from said insertion distance storage;

code processing means for receiving a distance representative code accessed by said storage control means and for writing said distance representative code into an indexing code storage location;

insertion control means, responsive to a transition in the state of said detection signal indicating movement of said paper hold-down device from said second position, for accessing said indexing code storage location to obtain said distance representative code and for supplying a corresponding set of control signals to said indexing device, whereby a sheet of paper is advanced a distance from said entrance point that corresponds to an operator depression of a number key.

* * * * *